US012329271B2

(12) United States Patent
McLean

(10) Patent No.: US 12,329,271 B2
(45) Date of Patent: Jun. 17, 2025

(54) HAMMOCK MOUNTING SYSTEMS

(71) Applicant: MCLEAN METALWORKS, LLC, Bend, OR (US)

(72) Inventor: Christopher McLean, Bend, OR (US)

(73) Assignee: MCLEAN METALWORKS, LLC, Bend, OR (US)

( * ) Notice: Subject to any disclaimer, the term of this patent is extended or adjusted under 35 U.S.C. 154(b) by 156 days.

(21) Appl. No.: 18/323,153

(22) Filed: May 24, 2023

(65) Prior Publication Data

US 2023/0389682 A1 Dec. 7, 2023

Related U.S. Application Data

(60) Provisional application No. 63/348,718, filed on Jun. 3, 2022.

(51) Int. Cl.
*A45F 3/24* (2006.01)

(52) U.S. Cl.
CPC ..... *A45F 3/24* (2013.01)

(58) Field of Classification Search
CPC ..... A45F 3/22; A45F 3/24; A45F 3/26; A45F 4/08
See application file for complete search history.

(56) References Cited

U.S. PATENT DOCUMENTS 4,797,961 A * 1/1989 Pasquariello ..... A45F 3/24 5/127
5,003,652 A * 4/1991 Bayless ..... A45F 3/24 5/127
5,740,570 A * 4/1998 Hsieh ..... A45F 3/24 5/127
5,983,422 A * 11/1999 Bayless ..... A45F 3/24 5/120
6,739,643 B1 5/2004 Rock et al.
7,073,857 B1 7/2006 Bailey
7,272,865 B2 9/2007 Le Gette et al.
7,996,935 B1 * 8/2011 Chen ..... A45F 3/24 5/120
9,072,368 B2 7/2015 Mueller
9,179,759 B1 11/2015 Turner
9,526,319 B2 12/2016 Jungling
9,861,180 B1 1/2018 Jungling
(Continued)

OTHER PUBLICATIONS

McLean Metalworks Design & Manufacturing, Hammock Mount, Wayback Machine, accessed online, as early as Apr. 28, 2022, retrieved May 24, 2023, "http://web.archive.org/web/20220428052359/https://www.mcleanmetalworksmfg.com", 3 pages.

*Primary Examiner* — George Sun
(74) *Attorney, Agent, or Firm* — Leber IP Law; Celia H. Leber

(57) ABSTRACT

Hammock mounting systems are disclosed herein that may be used to mount a hammock in a variety of ways, including anchoring the system to a vehicle roof rack or from bed rails extending across a truck bed, or using the system as a hammock stand positioned on the ground. These hammock mounting systems include arms that can be deployed in one or more hammock-supporting positions, or folded flat to provide a low profile for height clearance. In some implementations the hammock mounting systems are adjustable to allow the system to be secured to anchor points located various distances apart.

20 Claims, 12 Drawing Sheets

(56) References Cited

U.S. PATENT DOCUMENTS

| | | | | |
|---|---|---|---|---|
| 2013/0117931 | A1* | 5/2013 | Lemmens | A45F 3/24 5/120 |
| 2016/0058197 | A1* | 3/2016 | Jungling | A45F 3/24 5/119 |
| 2016/0088922 | A1* | 3/2016 | Frankson | A45F 3/24 5/129 |
| 2019/0000220 | A1* | 1/2019 | Lemmens | A45F 3/24 |
| 2019/0090618 | A1* | 3/2019 | McDermott | A45F 3/26 |
| 2019/0365085 | A1* | 12/2019 | Goodwin | A45F 3/24 |
| 2020/0260845 | A1* | 8/2020 | Bingener | A45F 3/24 |
| 2022/0273090 | A1* | 9/2022 | Zhang | A45F 3/24 |
| 2023/0157437 | A1* | 5/2023 | Zhu | A45F 3/24 5/127 |

* cited by examiner

HAMMOCK MOUNTING SYSTEMS

RELATED APPLICATION

The present application claims priority from U.S. Provisional Patent Application No. 63/348,718, filed on Jun. 3, 2022, and herein incorporated by reference in its entirety.

BACKGROUND

Hammocks are commonly used for relaxing, sleeping and camping. They are typically anchored above the ground to immoveable objects such as trees, posts, or hammock stands designed for this purpose, such that the hammock is suspended above the ground. The suspended weight of the hammock user(s) requires that the anchor points be properly spaced and securely mounted. Many locations lack anchor points to attach a hammock, and hammock stands are not always practical to transport or easy to deploy in all locations.

Hammock stand systems have been developed and sold commercially that utilize the trailer hitch of a vehicle as a mounting point for a hammock stand. In these systems, sold under the tradename Adventure Hammock Systems, the hammock stand is cantilevered out from the rear of the vehicle and includes telescoping arms that suspend the hammock user above the ground behind the vehicle.

SUMMARY

Hammock mounting systems are disclosed herein that may be used to mount a hammock in a variety of ways, including anchoring the system to a vehicle roof rack or from bed rails extending across a truck bed, or using the system as a hammock stand positioned on the ground. These hammock mounting systems include arms that can be deployed in one or more hammock-supporting positions, or folded flat to provide a low profile for height clearance. In some implementations the hammock mounting systems are adjustable to allow the system to be secured to anchor points located various distances apart.

In one aspect, the disclosure features a hammock mounting system comprising: (a) a central bar configured to be disposed generally parallel to a surface above which a hammock is mounted; (b) a pair of mounting frames mounted on the central bar, the mounting frames being configured to attach the system to a pair of spaced mounting points; and (c) a pair of arms pivotably mounted on the mounting frames to move between an extended position in which the arms are positioned to suspend the hammock above the surface, and a folded position in which the arms are adjacent to the central bar.

Some implementations include one or more of the following features. The mounting frames may be slidably mounted on the central bar and configured to be locked in a desired spacing along the length of the central bar. The bar may comprise a T-slotted framing rail and the mounting frames may include apertures configured to receive T-slotted framing fasteners. The arms may each be a single, integral tubular member (i.e., in some implementations the arms are not telescoping). The mounting frames may include apertures configured to allow the mounting frames to be removably fastened to mounting locations. The arms may include detents configured to selectively lock the arms in the extended position and the folded position. For example, the detents may comprise a pair of spring-loaded pins configured to releasably lock the arms in the extended and folded positions. The system may further include accessory elements configured to be mounted to the mounting frames generally perpendicular to a longitudinal axis of the bar, longitudinal axes of the accessory elements being generally coplanar with the longitudinal axis of the bar, to support the system on a ground surface.

In another aspect, the disclosure features a hammock mounting system comprising (a) a central bar configured to be disposed generally parallel to a surface above which a hammock is mounted; (b) a pair of mounting frames slidably mounted on the central bar and fixable in a predetermined spacing along the length of the bar, the mounting frames being configured to attach the system to a pair of spaced mounting points; and (c) a pair of arms pivotably mounted on the mounting frames to move between an extended position in which the arms are positioned to suspend the hammock above the surface, and a folded position in which the arms are adjacent to the central bar.

Some implementations may include one or more of the features discussed above.

In another aspect the disclosure features a method of mounting a hammock on a vehicle. The method includes (a) providing a hammock mounting system, the system comprising (i) a central bar configured to be disposed generally parallel to a surface above which a hammock is mounted; (ii) a pair of mounting frames mounted on the central bar; and (iii) a pair of arms pivotably mounted on the mounting frames to move between an extended position in which the arms are positioned to suspend the hammock above the surface, and a folded position in which the arms are adjacent to the central bar; and (b) mounting the mounting frames on spaced mounting points on a vehicle.

In some implementations the method may include one or more of the following features. Mounting may include inserting fasteners through apertures in the mounting frames and corresponding apertures in the mounting points. The mounting frames may be slidably mounted on the bar and mounting may further include sliding the mounting frames to a spacing corresponding to the distance between the mounting points on the vehicle. The method may further include moving the arms to the extended position and attaching a hammock to attachment points at distal ends of the arms. The method may further include removing the system from the vehicle and attaching accessory elements to the system to allow the system to be a ground-supported hammock stand.

The arms may include detents configured to lock the arms in the extended position and the method may further include engaging the detents to lock the arms in the extended position.

Within this specification embodiments have been described in a way which enables a clear and concise specification to be written, but it is intended and will be appreciated that embodiments may be variously combined or separated without parting from the invention. For example, it will be appreciated that all preferred features described herein are applicable to all aspects of the invention described herein.

DETAILED DESCRIPTION

Figure 1:
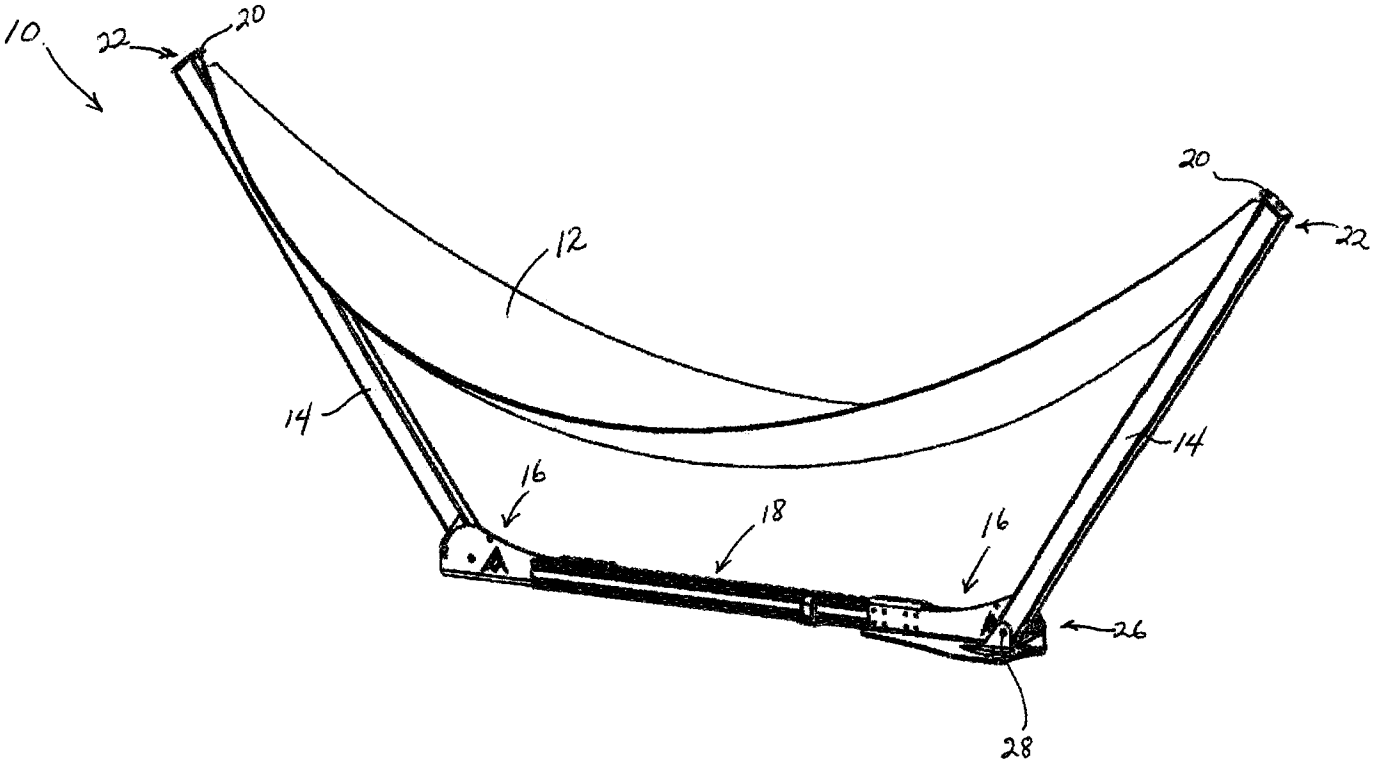
FIG. 1 is a perspective view of a hammock mounting system according to one implementation, with a hammock supported by the system.

Referring to FIG. 1, a hammock mounting system 10 is shown supporting a hammock 12. The hammock mounting system 10 includes a pair of support arms 14 that are pivotably mounted on corresponding mounting frames 16, shown in detail in FIGS. 3 and 3A. The mounting frames 16 are connected by a bar 18 that is configured to allow the spacing between the mounting frames to be adjusted, as will be discussed in detail below. The hammock 12 is suspended from mounting points 20 at the distal ends 22 of the arms 14. Mounting points 20 may be, for example, plates fixedly mounted to the arms that include apertures 21 (FIG. 2B) configured to receive a carabiner or other clip.

These mounting points 20 and apertures 21 can also be used to attach accessories to the mounting system 10, for example an awning configured to extend over the hammock, such as the awning kits sold by Adventure Hammock Systems.

Figure 2:
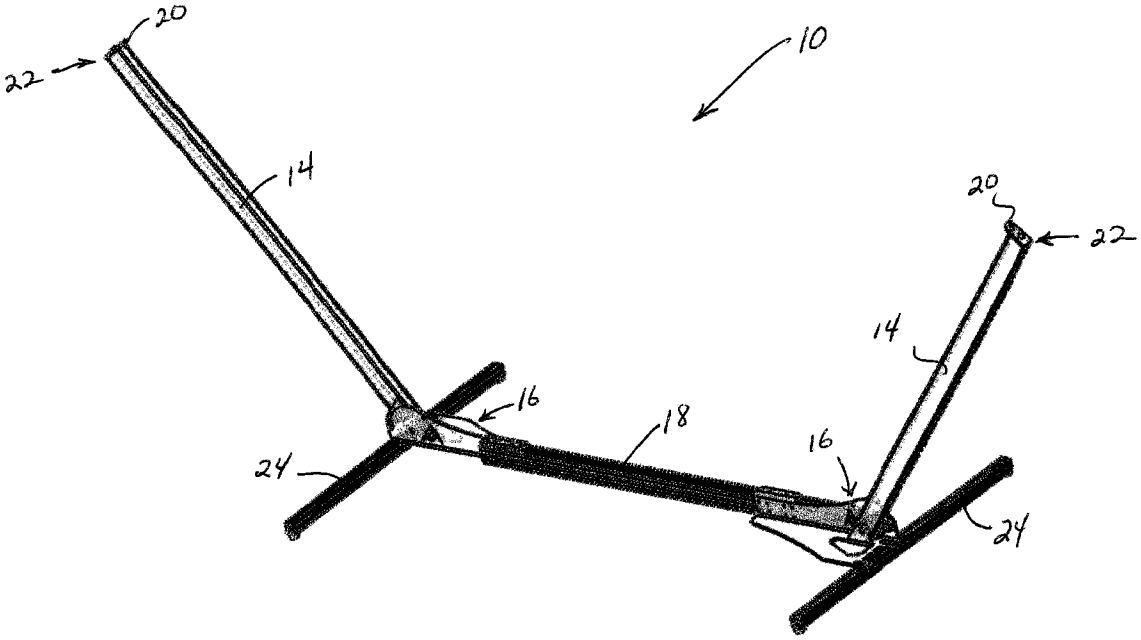
FIG. 2 is a perspective view of the system in isolation, with the hammock removed and accessory elements used to convert the system to a ground-supported hammock stand.
Figure 2A:
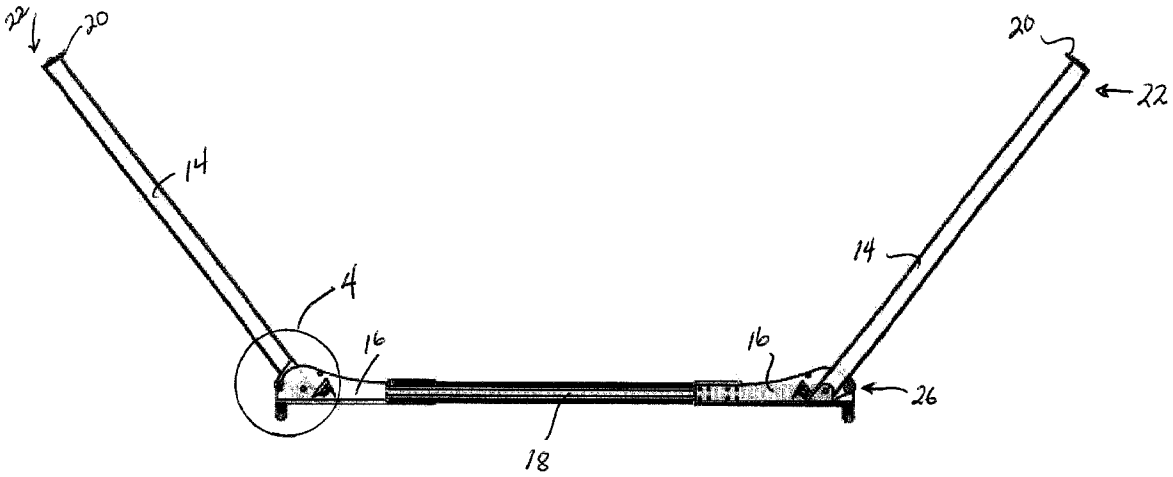
FIG. 2A is a side view of the system shown in FIG. 2.
Figure 2B:
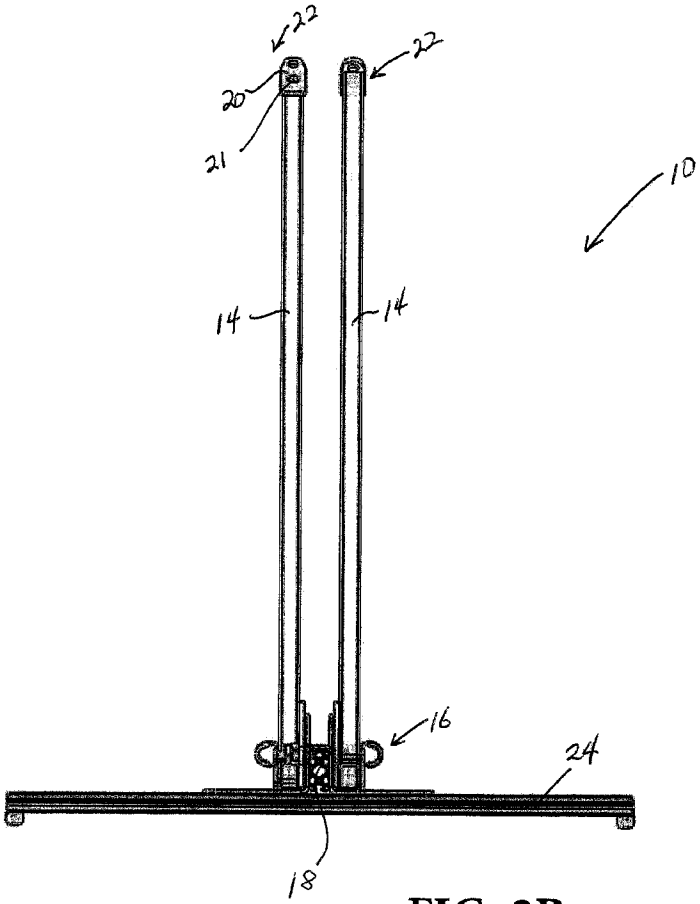
FIG. 2B is an end view of the system shown in FIG. 2.

Referring now to FIG. 2, the mounting system 10 can further include accessory elements 24 to which the mounting frames 16 can be bolted. The accessory elements 24 extend generally perpendicular to the longitudinal axis of the bar 18 and serve to convert the mounting system 10 to a ground-mounted hammock stand. This allows users to use the mounting system as a conventional hammock stand, for example if the user does not wish to climb up onto the vehicle roof or truck bed or is not travelling and needs a hammock stand at home.

Figure 1A:
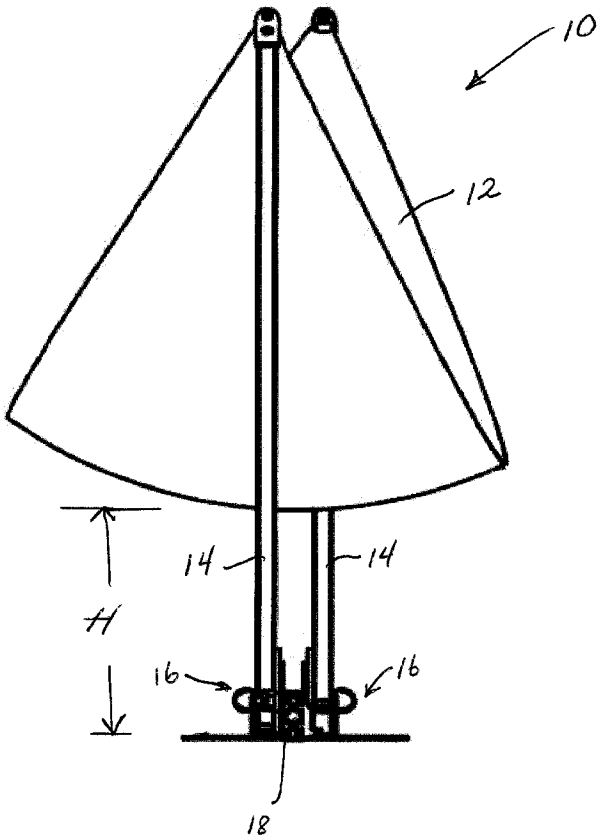
FIG. 1A is an end view of the system shown in FIG. 1.

Referring to FIG. 1A, it is important that the hammock remain, when loaded with the weight of a hammock user, a sufficient distance H above the surface below (e.g., the ground or the roof of the vehicle) for user comfort and safety. In some cases, distance H is at least six inches and preferably 1 to 2 feet. This distance is affected by the weight of the user and the material of the hammock but can generally be controlled within safe limits by adjusting the distance between the base of the arms 14 on the bar 18 and the angle at which the arms extend relative to the plane of the surface below.

It is generally preferred that the arms be formed of a single, unitary length of material, for example hollow tubing, as this provides optimal strength and simplicity of manufacturing. In some cases, the arms are formed of a tubular material having a rectangular cross section. In some implementations the arms are of a material that is weldable, to facilitate attachment of the plates that include apertures 21. Suitable materials include corrosion-resistant metals such as aluminum, or materials that have been coated to provide corrosion-resistance.

Figure 3:
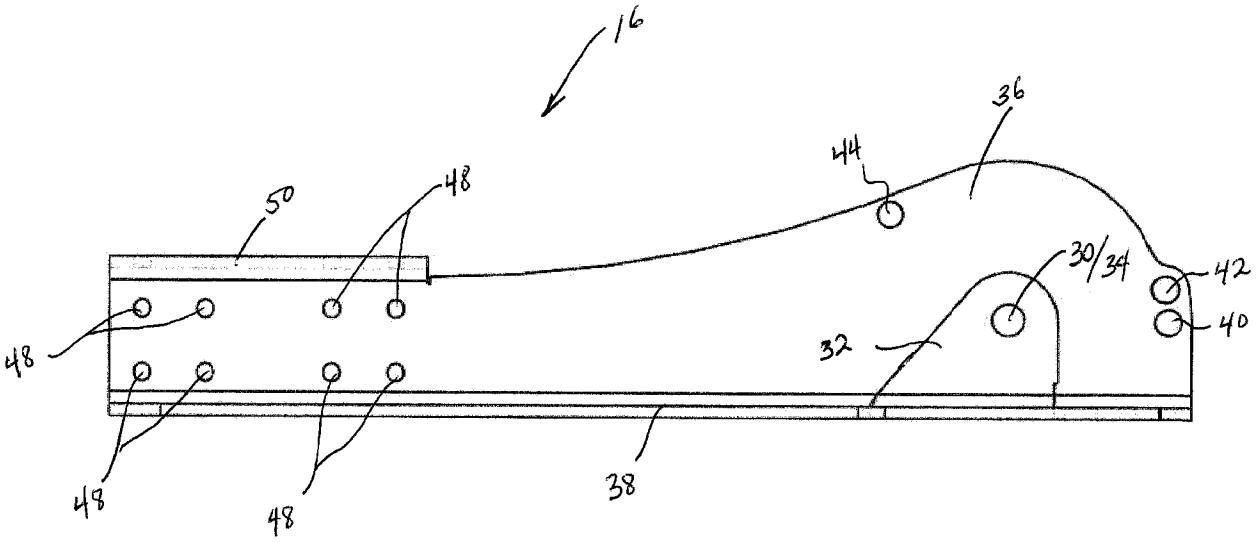
FIG. 3 is a side view of a mounting frame used in the system shown in FIG. 2.
Figure 3A:
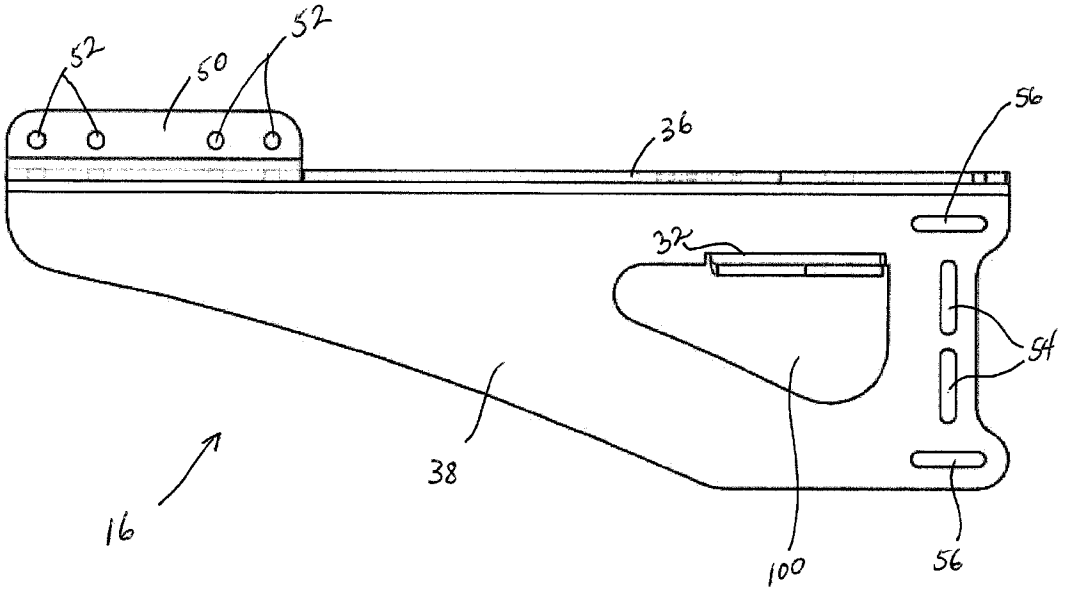
FIG. 3A is a top view of the mounting frame shown in FIG. 3.

The structure of mounting frames 16 is shown in detail in FIGS. 3 and 3A. As shown, e.g., in FIG. 1, each arm 14 is pivotably secured to the corresponding mounting frame 16 at its proximal end 26 by a bolt 28. Bolt 28 extends through an aperture in the arm 14 (not shown) and aligned apertures in the mounting frame 16 (referring to FIG. 3, an aperture 30 in support 32 and an aligned aperture 34 in main flange 36.) Main flange 36 and support 32 extend upwardly from a base plate 38 with their broad faces substantially parallel to each other, defining an arm-receiving channel in which the arm 14 can pivot, as shown in FIG. 6.

Figure 4:
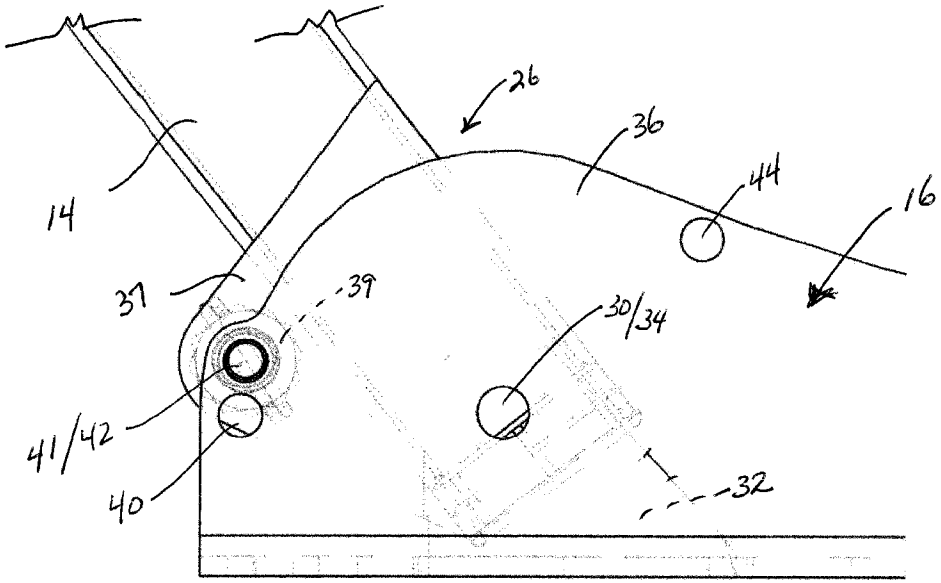
FIG. 4 is an enlarged detail view of portion 4 in FIG. 2A.

The arm 14 can be locked in three positions, using apertures 40, 42 and 44 in main flange 36 which are positioned to align with an aperture 41 (FIG. 4) in locking flange 37 (FIGS. 4 and 6) that extends from and is welded to the side of arm 14 that faces the main flange 36. A spring-loaded pin 39 that is mounted on the locking flange 37 in the aperture 41 is inserted into the desired aperture in the main flange 36 and allowed to spring into place, holding the arm in a desired position.

Figure 5:
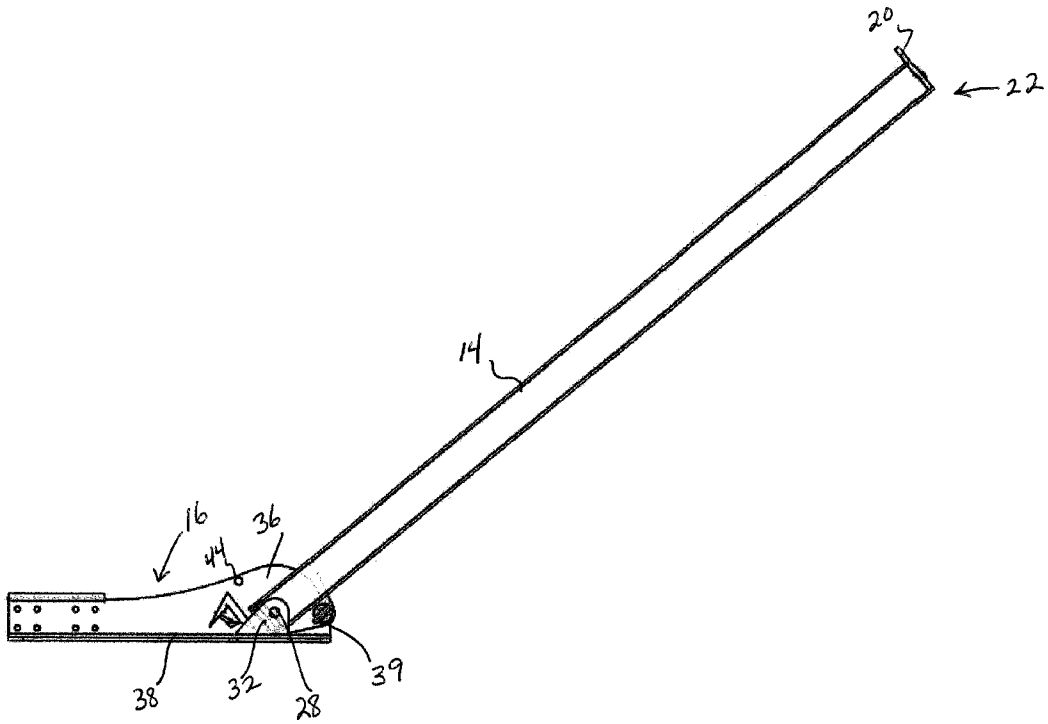
FIG. 5 is a partial side view of the system shown in FIG. 2, showing an arm in a first extended position.
Figure 5A:
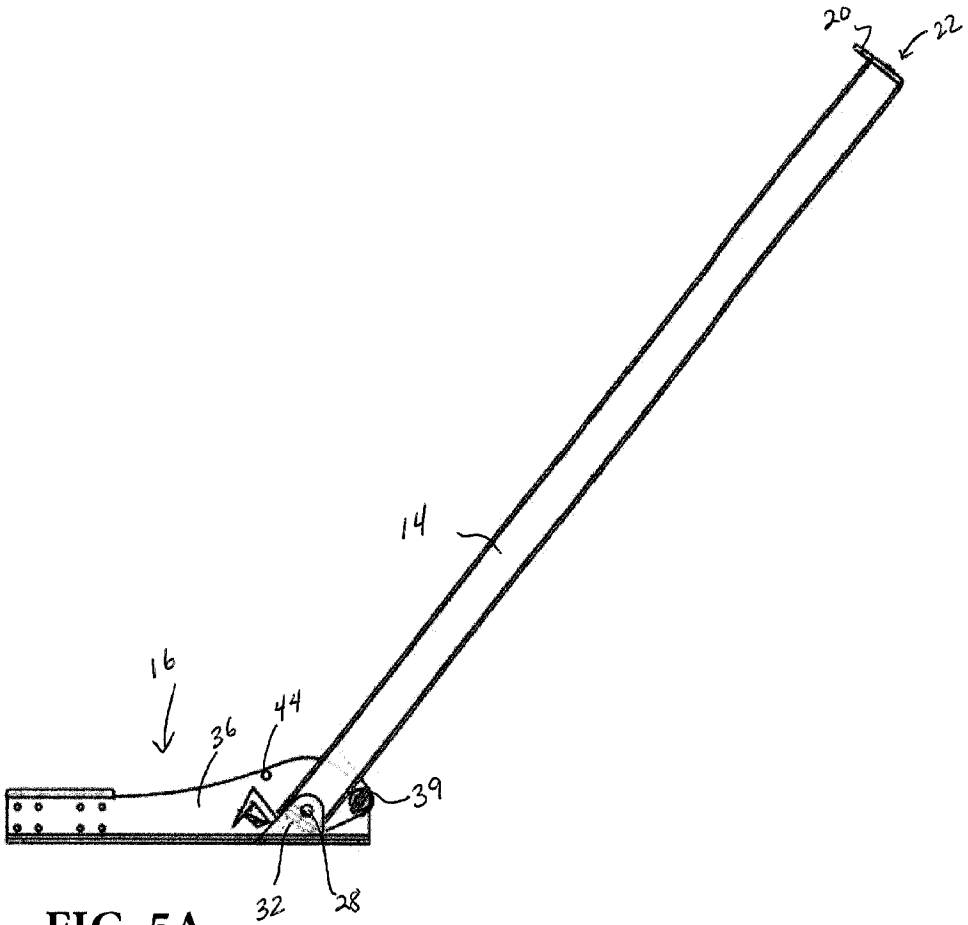
FIG. 5A is a partial side view similar to that in FIG. 5 but showing the arm in a second extended position.
Figure 5B:
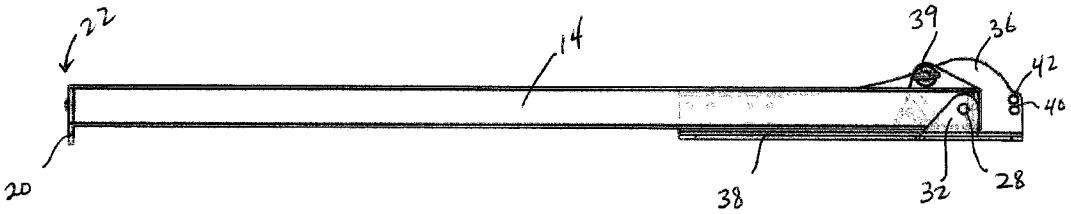
FIG. 5B is a partial side view similar to that in FIG. 5 but showing the arm in a folded position.

The three positions of the arm are shown in FIGS. 5-5B, in which FIG. 5 corresponds to the pin being positioned in aperture 40, FIG. 5A corresponds to aperture 42, and FIG. 5B corresponds to aperture 44. In FIG. 5, the distance between distal ends 22 of the arms is maximized (e.g., about 114 to 131 inches), in FIG. 5A it is slightly shorter (e.g., about 100 to 118 inches), and in FIG. 5B the arms 14 are folded and secured for transport. When the arms are in the extended positions shown in FIGS. 5 and 5B, the angle between each arm and the bar can be, for example, between about 125 and 145 degrees, e.g., between 128 and 140 degrees. In the position shown in FIG. 5, the vertical distance from the distal end 22 to the plane of bar 18 is about 35 to 40 inches, whereas in the position shown in FIG. 5 this distance is smaller, e.g., from about 30 to 34 inches.

Figure 6:
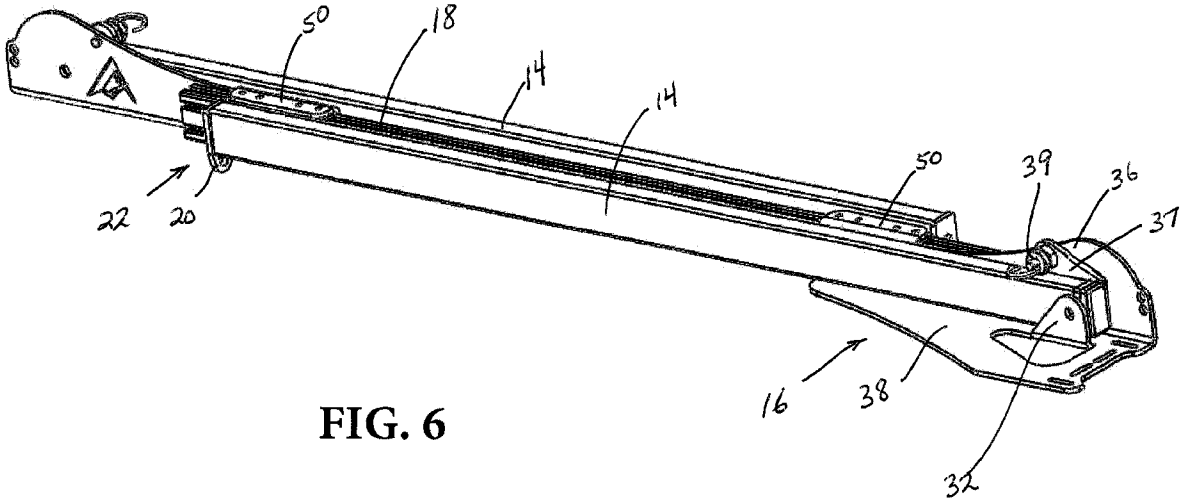
FIG. 6 is a perspective view showing the system of FIG. 2 in a folded position with the hammock stand accessory elements removed.

Referring to FIGS. 3, 3A and 6, each of the mounting frames 16 also includes features that allow the mounting frame to be slidably mounted on the bar 18. The bar 18 is preferably a T-slotted framing rail, such as those commercially available from, e.g., McMaster-Carr. The T-slotted profile can be seen in FIG. 2B. To attach the mounting frames 16 to the bar 18, apertures 48 are provided in main flange 36 (FIG. 3) through which compatible T-slotted framing fasteners can be inserted and slidably positioned in the side-facing channel of the T-slotted framing rail (bar 18). To provide a more secure attachment, an attachment flange 50 extends generally perpendicular to the plane of the broad surface of main flange 36 and includes apertures 52 (FIG. 3A) that allow T-slotted framing fasteners to be slidably positioned in the upper channel of the T-slotted framing rail. The positioning of the mounting frames 16 along the length of the bar 18 can thus be easily adjusted simply by loosening the T-slotted framing fasteners and sliding them along the channels in the bar 18. In some implementations the bar 18 is from about 40 to 60 inches, e.g., from about 45 to 55 inches, and the spacing between the pivot points of the arms 14 can be adjusted between about 45 and 70 inches, e.g., between about 48 and 67 inches.

The mounting frames 16 also allow the system 10 to be mounted securely on a desired surface (e.g., a vehicle roof rack or truck bed rail) or mounted to the accessory elements as shown in FIG. 2. Referring to FIG. 3A, the base plate 38 of each mounting frame 16 includes a plurality of elongated apertures 54 extending in a first direction, and elongated apertures 56 extending in a second direction substantially perpendicular to the first direction. As a result of their elongated shape and their relative orientations, these apertures allow considerable flexibility in the location and alignment of the mounting plates relative to available attachment points. Moreover, the T-slotted rail system discussed above allows wide adjustment of the spacing between the mounting frames 16 along the bar 18. Thus, the system 10 can be mounted on a variety of different vehicles by a single user, or a user can easily sell or loan the system 10 to another user who has a vehicle with different mounting points. Additionally, it is not necessary for a manufacturer of the system to sell the system in different sizes.

The system 10 is designed to safely support a load of up to 300 pounds. It is designed to permit a small degree of hammock sway.

Other Embodiments

A number of embodiments have been described. Nevertheless, it will be understood that various modifications may be made without departing from the spirit and scope of the disclosure.

For example, if desired the main flange 36 can include more apertures, for greater adjustability of the angular positioning of the arms, or fewer apertures (for example one for the deployed position and one for the folded, stowed position.)

Additionally, while a large aperture 100 is shown in the base plate 38 in the embodiment shown in FIG. 3A, this aperture is merely to reduce the weight of the system and facilitate its manufacture and can be omitted if desired.

Moreover, while the bar 18 is formed of T-slotted framing material in the implementation described above, other materials can be used. For example, the center bar may be formed of a tubular material (e.g., a perforated tubing such as that commercially available under the tradename TELESPAR® to provide the adjustable spacing described above). Suitable materials have sufficient strength to provide the hammock mounting system with the ability to safely support expected loads (e.g., up to 300 pounds). It is generally also preferred that the material be corrosion resistant.

Accordingly, other embodiments are within the scope of the following claims.

What is claimed is:

1. A hammock mounting system comprising:

a fixed length central bar configured to be disposed generally parallel to a surface above which a hammock is mounted;

a pair of mounting frames mounted on the central bar, the mounting frames being configured to attach the system to a pair of spaced mounting points, each of the mounting frames being configured to slide along the fixed length of the central bar and to be locked in a desired spacing along the fixed length central bar; and a pair of arms pivotably mounted on the mounting frames to move between an extended position in which the arms are positioned to suspend the hammock above the surface, and a folded position in which the arms are adjacent to the central bar.

2. The system of claim 1 wherein the bar comprises a T-slotted framing rail and the mounting frames include apertures configured to receive T-slotted framing fasteners.

3. The system of claim 1 wherein the arms are each a single, integral tubular member.

4. The system of claim 1 wherein the mounting frames include apertures configured to allow the mounting frames to be removably fastened to mounting locations.

5. The system of claim 1 wherein the arms include detents configured to selectively lock the arms in the extended position and the folded position.

6. The system of claim 5 wherein the detents comprise a pair of spring-loaded pins configured to releasably lock the arms in the extended and folded positions.

7. The system of claim 1 further comprising accessory elements configured to be mounted to the mounting frames generally perpendicular to a longitudinal axis of the bar, longitudinal axes of the accessory elements being generally coplanar with the longitudinal axis of the bar, to support the system on a ground surface.

8. The system of claim 5 wherein each mounting frame includes a plurality of apertures, each arm includes an aperture adjacent a proximal end of the arm;

wherein the apertures on the mounting frames are positioned to align with the apertures on the corresponding arms, and the angular position of each arm relative to the central bar can be adjusted by a user by aligning one of the plurality of apertures in each mounting frame with the aperture in the corresponding arm and inserting a pin through the aligned apertures.

9. The system of claim 8 further comprising spring loaded pins mounted in the apertures on each of the arms and configured to spring into place in the aperture in the corresponding mounting frame when the user aligns the aperture in the arm with the aperture in the mounting frame to obtain a desired angular position of the arm.

10. A hammock mounting system comprising:

a central bar configured to be disposed generally parallel to a surface above which a hammock is mounted;

a pair of mounting frames slidably mounted on the central bar and configured to be locked in a desired spacing along a length of the bar, the mounting frames being configured to attach the system to a pair of spaced mounting points; and a pair of arms pivotably mounted on the mounting frames to move between an extended position in which the arms are positioned to suspend the hammock above the surface, and a folded position in which the arms are adjacent to the central bar; wherein each mounting frame includes a plurality of apertures, and each arm includes an aperture adjacent a proximal end of the arm; and wherein the apertures on the mounting frames are positioned to align with the apertures on the corresponding arms, and the angular position of each arm relative to the central bar can be adjusted by a user by aligning one of the plurality of apertures in each mounting frame with the aperture in the corresponding arm and inserting a pin through the aligned apertures.

11. The system of claim 10 wherein the bar comprises a T-slotted framing rail and the mounting frames include apertures configured to receive T-slotted framing fasteners.

12. The system of claim 10 wherein the arms are each a single, integral tubular member.

13. The system of claim 10 further comprising detents configured to lock the arms in the extended position.

14. The system of claim 13 wherein the detents comprise a pair of spring-loaded pins configured to releasably lock the arms in the extended and folded positions.

15. A method of mounting a hammock on a vehicle, the method comprising:

(a) providing a hammock mounting system, the system comprising a fixed length central bar configured to be disposed generally parallel to a surface above which a hammock is mounted;

a pair of mounting frames mounted on the central bar, the mounting frames being configured to attach the system to a pair of spaced mounting points, and being slidably mounted on the fixed length central bar and configured to be locked in a desired spacing along the fixed length of the central bar; and a pair of arms pivotably mounted on the mounting frames to move between an extended position in which the arms are positioned to suspend the hammock above the surface, and a folded position in which the arms are adjacent to the central bar; and (b) sliding the mounting frames in a desired spacing corresponding to locations of spaced mounting points on a vehicle; and (c) mounting the mounting frames on the spaced mounting points on the vehicle.

16. The method of claim 15 wherein mounting comprises inserting fasteners through apertures in the mounting frames and corresponding apertures in the mounting points.

17. The method of claim 15 wherein positioning comprises sliding the mounting frames to a spacing corresponding to a distance between the mounting points on the vehicle.

18. The method of claim 15 further comprising moving the arms to the extended position and attaching a hammock to attachment points at distal ends of the arms.

19. The method of claim 15 further comprising removing the system from the vehicle and attaching accessory elements to the system to allow the system to be a ground-supported hammock stand.

20. The method of claim 18 wherein the arms include detents configured to lock the arms in the extended position and the method further includes engaging the detents to lock the arms in the extended position.

* * * * *